US009597812B2

(12) United States Patent
Schmeiser

(10) Patent No.: US 9,597,812 B2
(45) Date of Patent: Mar. 21, 2017

(54) SLICING DEVICE COMPRISING A PRODUCT GRIPPER

(71) Applicant: GEA Food Solutions Germany GmbH, Biedenkopf-Wallau (DE)

(72) Inventor: Jörg Schmeiser, Wiggensbach (DE)

(73) Assignee: GEA FOOD SOLUTIONS GERMANY GMBH, Biedenkopf-Wallan (DE)

( * ) Notice: Subject to any disclaimer, the term of this patent is extended or adjusted under 35 U.S.C. 154(b) by 60 days.

(21) Appl. No.: 14/397,670

(22) PCT Filed: Mar. 28, 2013

(86) PCT No.: PCT/EP2013/056639

§ 371 (c)(1),
(2) Date: Oct. 29, 2014

(87) PCT Pub. No.: WO2013/164143

PCT Pub. Date: Nov. 7, 2013

(65) Prior Publication Data

US 2015/0122095 A1 May 7, 2015

(30) Foreign Application Priority Data

Apr. 30, 2012 (DE) ..... 10 2012 008 428

(51) Int. Cl.
*B26D 7/06* (2006.01)
*B26D 7/02* (2006.01)
*B26D 7/01* (2006.01)

(52) U.S. Cl.
CPC ..... *B26D 7/0625* (2013.01); *B26D 7/025* (2013.01); *B26D 7/0683* (2013.01);
(Continued)

(58) Field of Classification Search
CPC B26D 7/0625; B26D 7/025; B26D 2007/011; B26D 2210/22; B26D 2007/013;
(Continued)

(56) References Cited

U.S. PATENT DOCUMENTS 4,015,494 A 4/1977 Spooner et al.
5,191,820 A * 3/1993 Hartmann ..... B26D 7/01 83/277

(Continued)

FOREIGN PATENT DOCUMENTS

DE 1985387 U 5/1968
DE 19518583 A1 11/1996

(Continued)

OTHER PUBLICATIONS

International Search Report, Application No. PCT/EP2013/056639, dated Dec. 20, 2013.

(Continued)

*Primary Examiner* — Ghassem Alie
(74) *Attorney, Agent, or Firm* — The Dobrusin Law Firm, P.C.

(57) ABSTRACT

A slicing device includes a cutting blade, a support, an endless belt, and a gripper. The cutting blade separates slices from a front end of a food product. The endless belt conveys the food product in a direction of a cutting blade and/or presses the food product against the support. The gripper is arranged on the endless belt so that the gripper is conveyed in a direction of a rear end of the food product to grip the rear end of the food product. A position of the gripper is moveable in a direction of the support. The endless belt includes a first portion and a second portion. The first portion is arranged closer to the cutting blade than the second (Continued)

portion. The first portion is arranged generally parallel to the support, and the second portion is arranged at an angle relative to the first portion.

16 Claims, 6 Drawing Sheets

(52) U.S. Cl.
CPC .. *B26D 2007/011* (2013.01); *B26D 2007/013* (2013.01); *B26D 2210/02* (2013.01); *Y10T 83/0538* (2015.04); *Y10T 83/6579* (2015.04)

(58) Field of Classification Search
CPC ..... B26D 7/0683; B26D 5/02; B26D 1/143; B26D 7/2635; Y10T 83/6579; Y10T 83/0538
USPC ..... 83/42, 707, 23, 681, 714, 932, 446, 449, 83/424
See application file for complete search history.

(56) References Cited

U.S. PATENT DOCUMENTS 5,423,250 A * 6/1995 Anderson ..... B26D 3/22 83/404
5,787,776 A 8/1998 Nishimoto
8,892,239 B2 * 11/2014 Weber ..... B26D 5/007 426/518
2005/0000346 A1 * 1/2005 Hartley ..... B26D 1/00 83/714
2009/0120256 A1 * 5/2009 Pasek ..... B26D 5/32 83/446
2011/0265624 A1 * 11/2011 Pasek ..... B26D 7/225 83/409

FOREIGN PATENT DOCUMENTS

DE 19525742 A1 1/1997
DE 10353114 A1 5/2005
DE 102007063112 A1 7/2009
DE 102008020246 A1 11/2009
DE 102010008047 A1 8/2011
EP 0107056 A2 5/1984
EP 0930137 A2 7/1999
FR 2677573 A1 12/1992
GB 2386317 A 9/2003
WO 2000/059689 A1 10/2000
WO 2005/037501 A2 4/2005
WO 2010/011237 A1 1/2010
WO 2011/079893 A2 7/2011

OTHER PUBLICATIONS

International Preliminary Report on Patentability, Application No. PCT/EP2013/056639, Aug. 19, 2014.

* cited by examiner

SLICING DEVICE COMPRISING A PRODUCT GRIPPER

The present invention relates to a slicing device which comprises a cutting blade which separates slices from the front end of a food product, wherein a means conveys the rood product in the direction of the cutting blade and/or presses it against a support and a gripper grips the rear end of the product. A further object of the present invention is a method for slicing a food product which rests on a support, is conveyed in the direction of a cutting blade and the rear end of which is moved into contact with a gripper.

These types of slicing devices or methods are adequately known from the prior art. In the case of said slicing devices, a food product rests on a support and is conveyed in the direction of a moving, preferably rotating, cutting blade which cuts food slices from the front end of the food product. In this case, the food product is conveyed by a means which is situated above the food product, for example a belt, in the direction of the cutting blade and/or is pressed against the support. In addition, the rear end of the food product is moved into engagement with a gripper prior to or during the cutting process, in particular to stabilize the food product if it has already been sliced comparably near the end and/or to dispose of the remaining piece. The disadvantage of the slicing devices according to the prior art, however, is that the position of the gripper cannot be adapted to the changing caliber of the food product and/or that the drive of the gripper is comparatively costly.

Consequently, the object of the present invention has been to provide a slicing device which does not comprise the disadvantages of the prior art.

The object is achieved with a slicing device which comprises a cutting blade which separates slices from the front end of a food product, wherein a means conveys the product in the direction of the cutting blade and/or presses it against a support and a gripper grips the rear end of the product and the spacing between the gripper and the support is modifiable.

The statements made concerning said object of the present invention are equally applicable to the other objects of the present invention and vice versa.

The present invention relates to a slicing device which comprises a cutting blade which separates food slices from the front end of a food slab. In this case, the food product rests on a support and is conveyed intermittently or continuously in the direction of the cutting blade which preferably rotates. The thickness of the respective food slice is determined by the forward feed of the food slab between two cuts. According to the invention, the rear end of the food product is gripped by a gripper prior to or during slicing in order to stabilize the food product, in particular when the slicing thereof has already progressed comparatively close to the end and/or in order to dispose of the remaining end piece.

It is now possible according to the invention to modify the spacing between the gripper and the support. As a result, for example the position of the gripper is able to be adapted to the food product, in particular to the diameter thereof. The gripper is preferably moved relative to the support, which is preferably stationary and the position of which is modified if need be for loading the slicing device. The gripper is preferably moved perpendicularly to the conveying direction of the food slab, the movement of the gripper in a particularly preferred manner comprising a vertical component. The gripper is preferably driven by motor, in particular by a servomotor.

A further object of the present invention is a slicing device which comprises a cutting blade which separates slices from the front end of a food product, wherein a means conveys the food product in the direction of the cutting blade and/or presses it against a support and a gripper grips the rear end of the product and the gripper is arranged on the means so as to be modifiable in its position.

The statements made concerning said object of the present invention are equally applicable to the other objects of the present invention and vice versa.

The slicing device according to said object of the present invention comprises a means which conveys the food product in the direction of the cutting blade and/or presses it against the support on which the food product rests and conveys it in the direction of the cutting blade. The food product, in this case, is situated between the means the support. For example, the means is a roller, preferably a traction roller. However, the means is preferably a conveyor belt, in particular an endless belt. Said endless belt abuts against the food product at least sometimes prior to and/or during slicing and presses it against the support and/or conveys it in the direction of the cutting blade. The endless belt is preferably realized as a so-called traction belt, in particular as an endless traction belt, i.e. its surface facing the food product interacts in a frictional, form-fitting and/or force-fitting manner with the endless belt. According to the invention, the gripper is arranged on the means, for example the endless belt, in particular the endless traction belt. The means, in particular the endless belt, conveys the gripper in the direction of the cutting blade and away from said cutting blade. The gripper, in this case, preferably completes, at least substantially, preferably totally, the same path as the means. In addition according to the invention, the gripper is arranged so as to be modifiable in its position relative to the means. The gripper can preferably be moved perpendicularly to the conveying direction of the means, with a movement component in the direction of the support and away from said support, i.e. preferably 90° with respect to the conveying direction of the means. The gripper is preferably fixed in its position relative to the means until its position is once again adapted to the next food product.

The advantage of the slicing device according to the invention is that the position of the means which conveys the food product in the direction of the cutting blade and/or presses it against a support, is able to be modified without the spacing between the gripper and the support being changed. In addition, the position of the gripper can be better adapted to changing heights of the respective product.

The endless belt preferably comprises a first portion which is arranged relatively close to the cutting blade, and a second portion which is provided farther away from the cutting blade, the second portion being provided at an angle to the first portion. As a result of said angle, the spacing between the support and the top endless belt becomes greater as the distance from the cutting blade increases. When loading the slicing device with a new food product, the gripper is situated as a rule in the second portion and as a result is not in the way of a load or it is also possible to slice food products which project beyond the position of the gripper. Not until the food product has been sliced so much that its end is situated in front of the gripper, is it moved in the direction of the rear end of the food product, catches up with the food product and is moved into contact with it.

The means is preferably arranged above the food product at least in portions so as to be displaceable in the direction of the support. The advantage of said preferred embodiment of the present invention is that the top means is not moved into contact with the food slab until this is necessary or the position of the top means is able to be adapted to the height of the food product. For example, the means cannot be moved into contact with the food slab until the gripper has already been moved into engagement with the rear end of the food product or shortly thereafter. Said embodiment has advantages in particular when the gripper is arranged on the top endless belt and is approached to the rear end of the food product from behind.

A floating bearing, in particular an axial bearing, is preferably arranged between the gripper and the means. Said floating bearing allows the spacing between the endless belt and the gripper to be modifiable. Once the gripper is situated in the desired position relative to the endless belt, it is preferably fixed temporarily in said position.

A further object of the present invention is a slicing device where the means comprises a low-friction surface.

The statements made concerning said object of the present invention are equally applicable to the other objects of the present invention and vice versa.

The means is preferably a roller or an endless belt which is situated above the food product. As a result of the low-friction surface, the means is able to abut against the food product and nevertheless be moved relative to said food product without damaging it.

Yet another object of the present invention is a method for slicing a food product which rests on a support, is conveyed in the direction of a cutting blade and the rear end of which is moved into contact with a gripper where the spacing between the gripper and the support is modified prior to or during slicing.

The statements made concerning said object of the present invention are equally applicable to the other objects of the present invention and vice versa.

Yet another object of the present invention is a method for slicing a food product which rests on a support, is conveyed in the direction of a cutting blade and the rear end of which is moved into contact with a gripper, where the gripper is arranged on a top endless belt and its position is modified relative to the endless belt during the slicing of the food product.

The statements made concerning said object of the present invention are equally applicable to the other objects of the present invention and vice versa.

In the case of said object of the present invention, the top means can be moved relative to the gripper and/or the gripper can be moved relative to the top means. Thus, for example, the gripper can be moved first of all into the desired position and connected to the rear end of the food slab. The endless belt can then be pressed onto the periphery of the food slab without the position of the gripper relative to the food product changing. Once the product has been sliced, the endless belt can then be distanced from the end piece of the food product and the gripper is able to pull it over a waste chute.

The inventions are explained below by way of FIGS. 1-12. Said explanations are purely as an example and do not restrict the general concepts of the invention. The explanations are applicable equally to all the objects of the invention.

Figure 1:
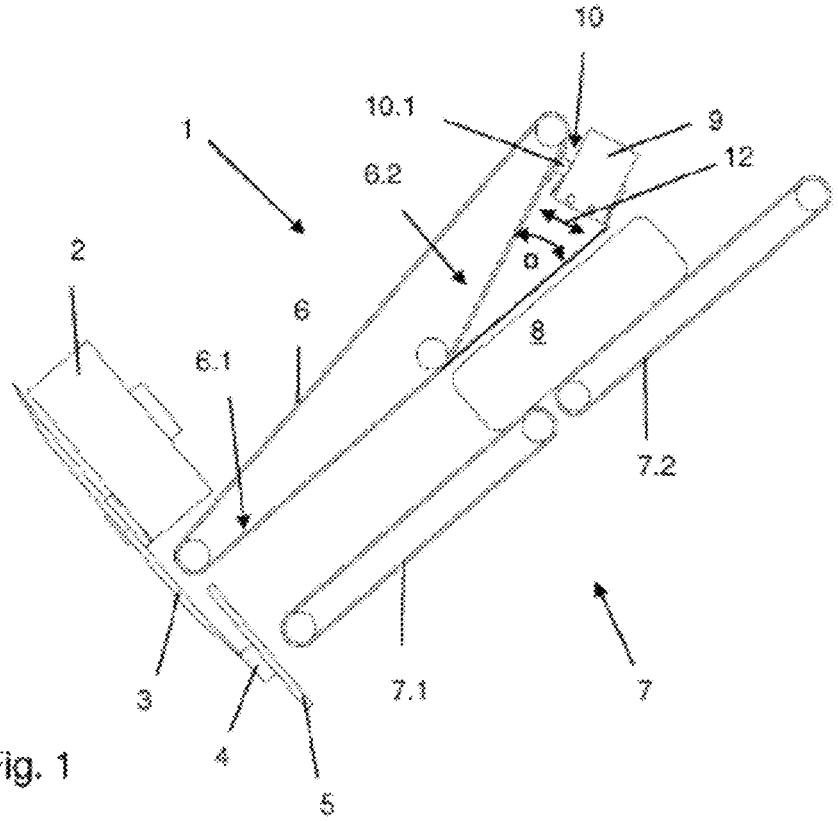
FIGS. 1-11 show the device according to the invention and the operation for slicing a food product.

FIG. 1 shows the slicing device according to the invention where a food slab 8 rests on a support 7 and is conveyed in the direction of a rotating cutting blade 3. The cutting blade, in the present case a circular blade, is arranged on a rotor 2 which drives the blade in a rotating manner and at the same time rotates along a circular path such that the cutting blade, at each revolution around the circular path, separates a slice from the food product and then releases the food product before the next slice is cut off. The cut food slices then fall onto a delivery table (not shown). The thickness of the food slice corresponds to the forward reed of the food product 8 between two cuts. During cutting, the cutting blade 3 interacts with a cutting edge 4 which is preferably situated on the front end of the support 7. In addition, the slicing device according to the invention comprises a top means 6, in the present case an endless belt, preferably an endless traction belt, which presses the food product 8 against the support 7 and/or conveys the food product 8 in the direction of the cutting blade 3. The endless belt 6 comprises in the present case a first portion 6.1 which is arranged closer to the cutting blade than a second portion 6.2.

The second portion 6.2 is provided at an angle $\alpha$ relative to the first portion. At least the first portion 6.1 of the means 6 is preferably provided so as to be movable in the direction of the support and away from said support. As a result, the spacing between the means 6 and the support can be modified, as a result of which, for example, the pressing force of the means 6 against the food product can be increased and/or the position of the means 6 can be adapted to the height of the product. According to the invention, a gripper 9, by way of which the rear end of the food product is gripped, is fixedly connected to the upper means 6, here the endless belt. The connection is effected in the present case by means of a floating bearing 10.1, here a cylinder 10.1, which is fixedly connected to the endless belt and also makes the movements thereof. The gripper 9 comprises a recess into which the cylinder 10.1 is inserted. The gripper 9 can be displaced in the axial direction of the cylinder 10.1 as well as relative to the same, as a result of which the spacing between the gripper 9 and the endless belt 6 is modified. The expert understands that other means for the linear displacement of the gripper are also possible. The support 7, in the present case, consists of two portions, the rear portion 7.2 preferably being realized so as to be rotatable. For loading the device according to the invention with a new product, the rear portion is preferably transferred into a lowered position and then, as soon as it has taken over the new food product, is raised again. Both portions preferably comprise in each case a conveying means, for example an endless belt, by way of which the food product is conveyed in the direction of the cutting blade. A gap, into which a slide, which functions as a stop, protrudes, is provided between the cutting edge 4 and the support 7.

Figure 2:
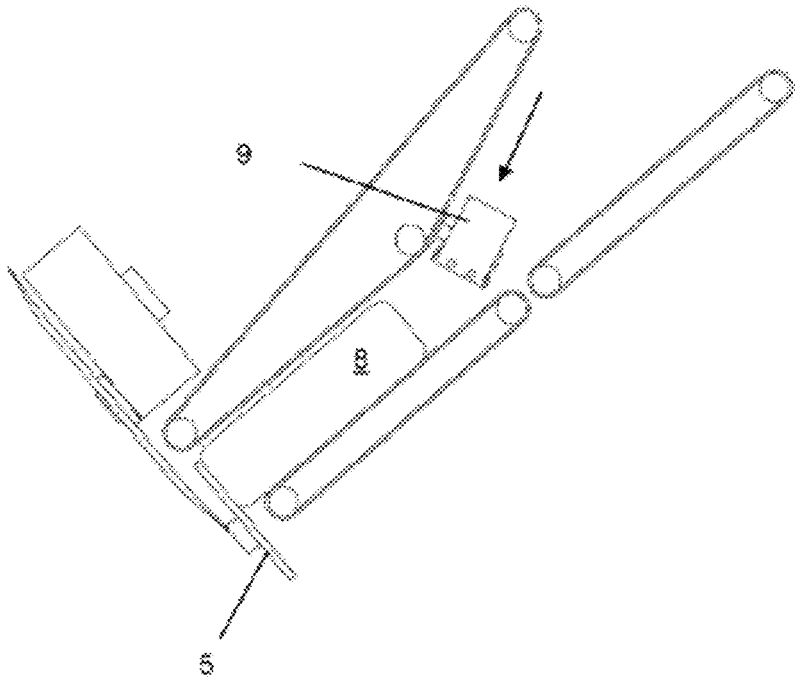
Figure 3:
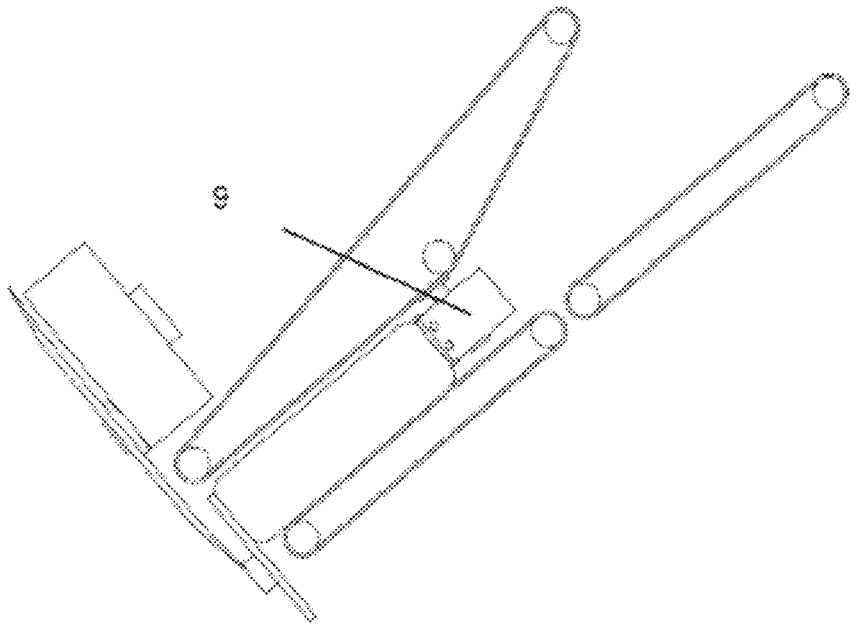
Figure 4:
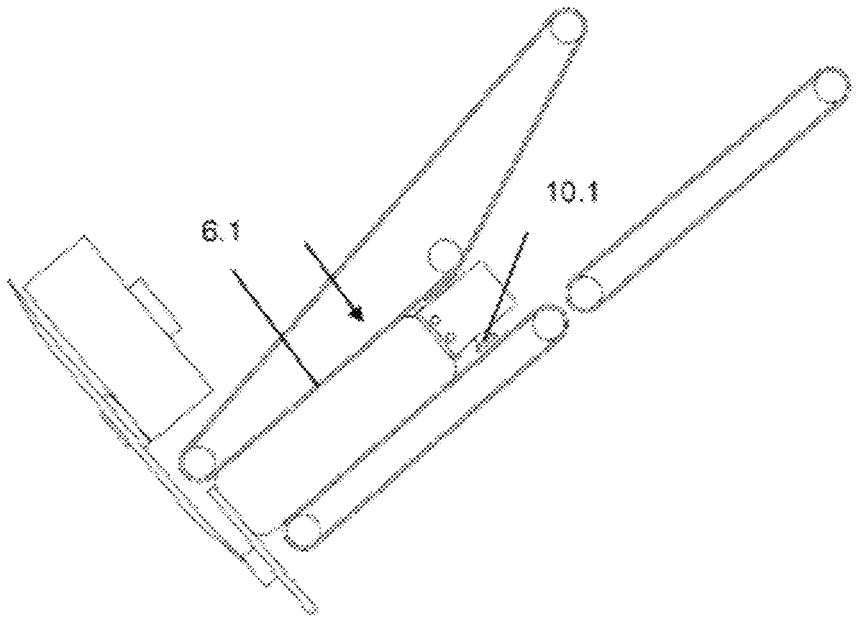
Figure 5:
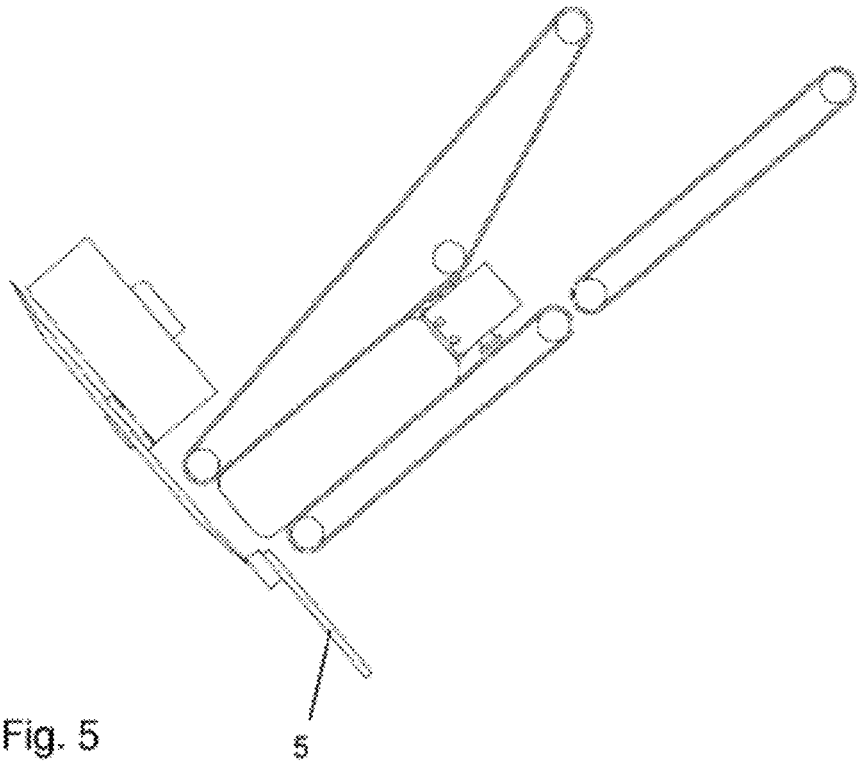
Figure 6:
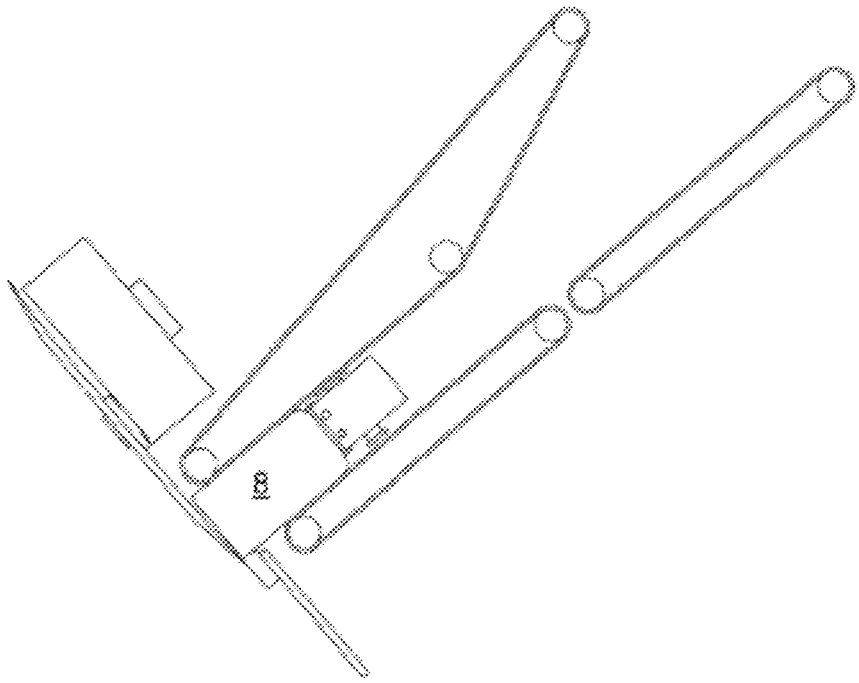
Figure 7:
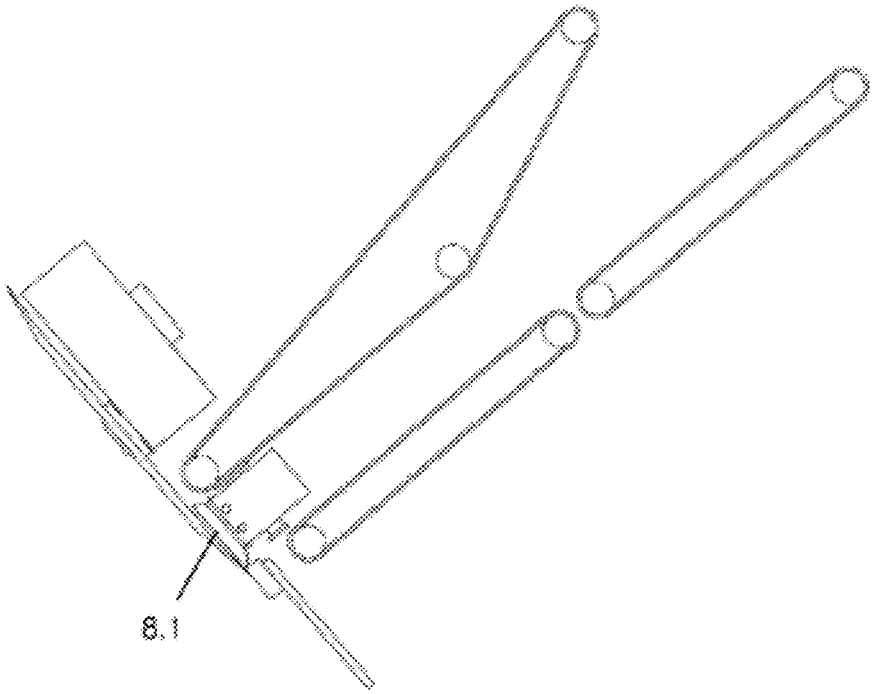
Figure 8:
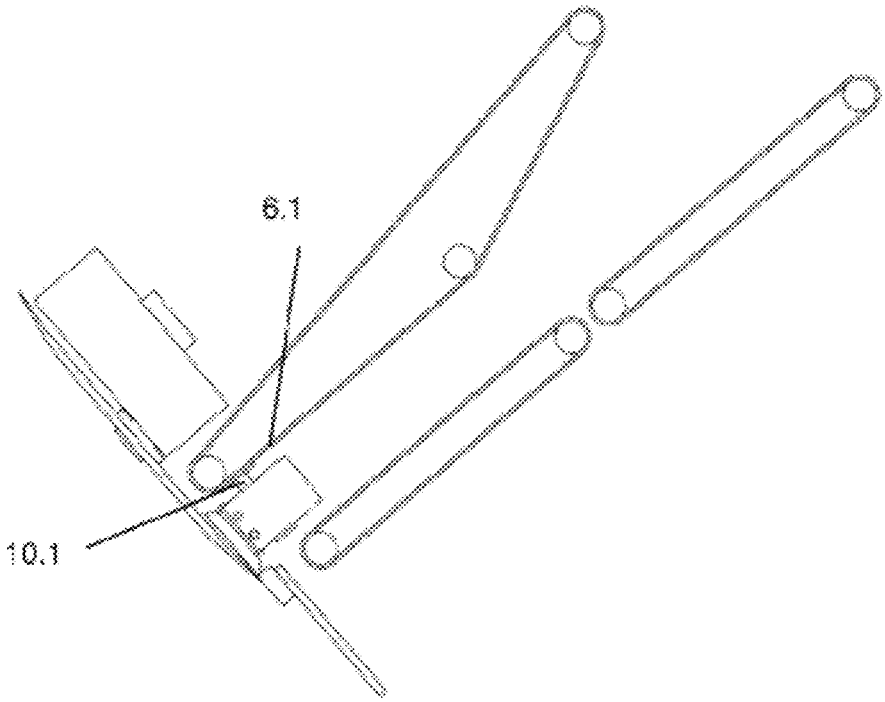
Figure 9:
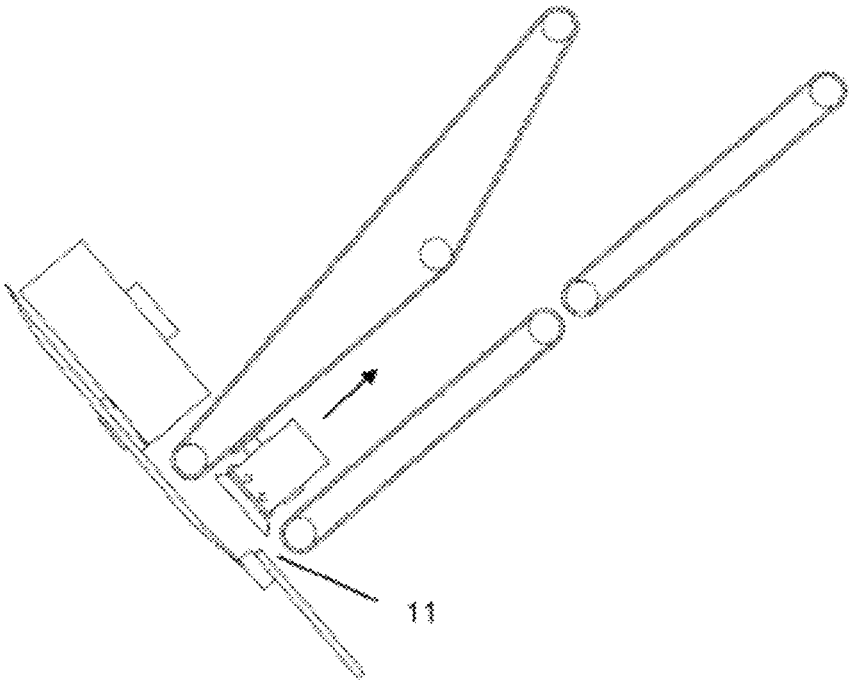
Figure 10:
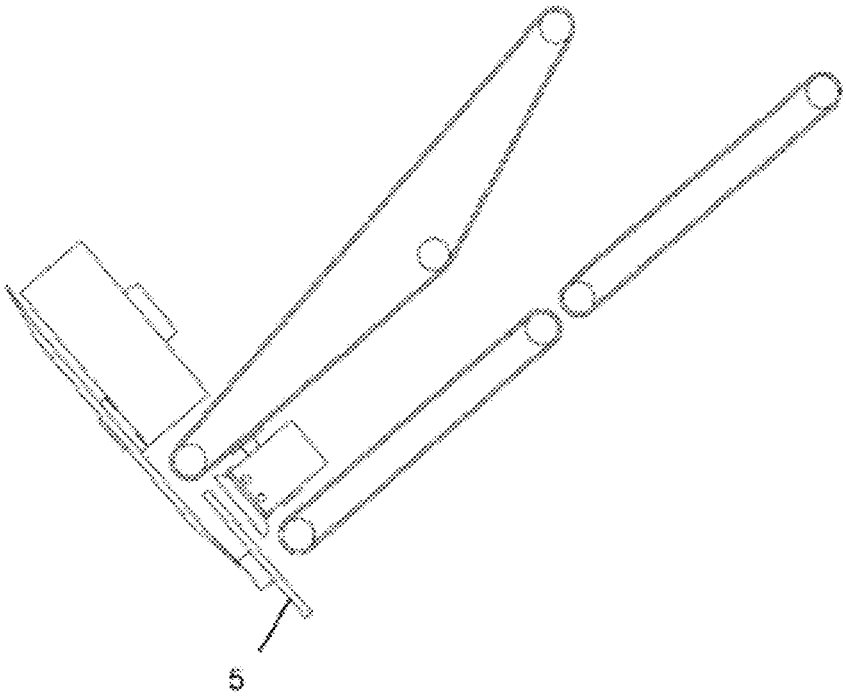
Figure 11:
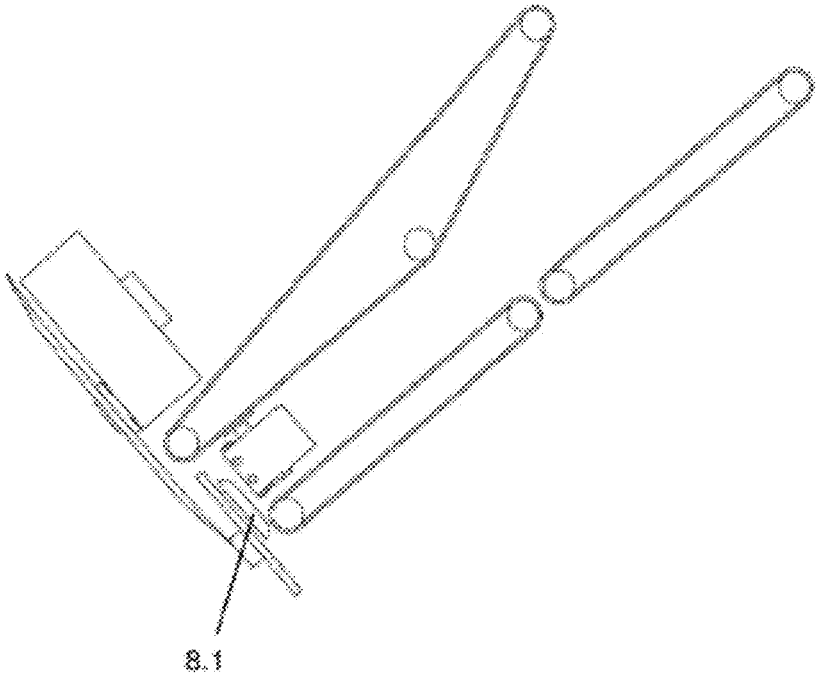

As soon as the food product 8 has been loaded onto the support 7, it is conveyed by the conveying means of the support 7 in the direction or the cutting blade 3 until its font end abuts against the stop 5. Then or at the same time, the gripper 9, as shown by the arrow, is conveyed in the direction of the rear end of the food product 8, by the means 6, here an endless belt, being turned clockwise (cf. FIG. 2). As soon as the gripper 9 has caught up with the rear end of the food product 8, (cf. FIG. 3), it is connected in a form-fitting and/or force-fitting manner to the food product. This occurs, for example, as a result of claws (not shown) being inserted into the rear end of the food product and/or the gripper 9 being fastened as a result of a vacuum on the rear end of the food product. The endless belt 6, in particular its first portion 6.1, is then moved in the direction of the support 7, which is symbolized by the arrow, in order to move the endless belt into abutment with the food product 8. In this case, the spacing between the gripper 9 and the endless belt 6 is reduced, whilst the spacing between the gripper and the support 7 remains constant. It can clearly be seen that the gripper is displaced along the cylinder 10.1. The gripper is preferably then fixed in its new position relative to the endless belt 6 (cf. FIG. 4). The slide 5 is then removed by being displaced, for example, under the conveying plane of the support 7 (cf. FIG. 5). The actual slicing operation is shown in FIG. 6. The cutting blade 3 cuts the food slices from the food product 8 and they then fall onto a delivery table (not shown) and are there configured to form portions and are then removed. During slicing, in particular towards the end of the slicing, the gripper 3 stabilizes the food product in its position between the support 7 and the endless belt 6. As soon as the food product has been completely sliced (cf. FIG. 7), the spacing between the endless belt 6 and the support 7 is enlarged again (cf. FIG. 8) such that the endless belt 6 no longer abuts against the remaining piece 8.1 of the food product. The remaining piece is then withdrawn from the gripper, which is symbolized by the arrow, until it is situated above a gap which is provided between the cutting edge and the support 7 (cf. FIG. 9). The slide is then moved upward again (cf. FIG. 10) and the engagement between the gripper 9 and the remaining piece 8.1 is released such that said remaining piece slips along the slide 5 into the gap 12 and there into a storage container (cf. FIG. 11). The gripper is then pulled back into its positions shown in FIG. 1 and the slicing of a new food product can begin.

Figure 12:
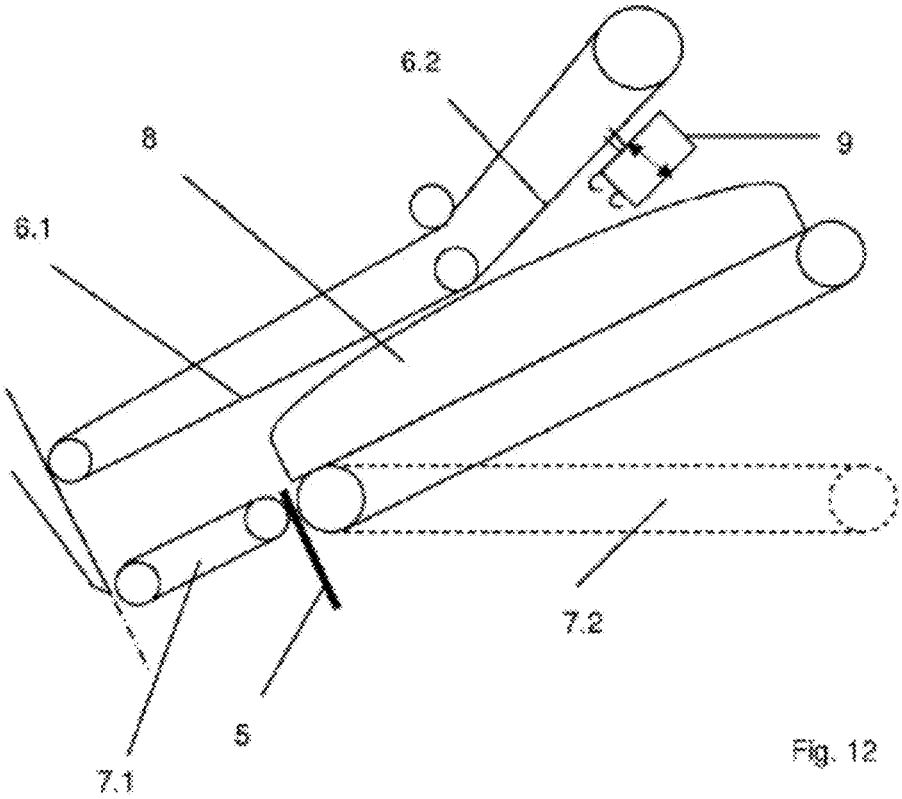
FIG. 12 shows the slicing of a long food product.

FIG. 12 shows the slicing of a long food product 8, the rear end of which projects beyond the position of the gripper 9. The loading of the slicing device according to the invention with a new food product 8 is effected by means of the loading rocker arm 7.2 which is moved into a horizontal positioned for loading. As soon as the food product is situated on the loading rocker arm 7.2, said loading rocker arm is raised again and the food product is then conveyed in the direction of the cutting blade 3 which slices the food product into food slices. Prior to or during slicing, the spacing between the endless belt 6 and the gripper 9 or between the support 7 and the gripper 9 is adjusted for example corresponding to the height of the product. As soon as the rear end of the food product 8 is situated in front of the gripper 9 or as soon as the rear end of the food product 8 is situated below the portion 6.1 of the endless belt 6 which is parallel with the support, once the gripper has caught up with the food product the gripper 9 is moved into engagement with the rear end of the food product. Otherwise, reference can be made to the statements according to FIGS. 1-11, in the present case the slide 5 being situated between the two portions 7.1 and 7.2 of the support 7.

LIST OF REFERENCES

1 Slicing device
2 Rotor
3 Cutting blade
4 Cutting edge
5 Slide, stop
6 Means, conveying means, traction means, traction belt, top traction belt
6.1 Front portion
6.2 Rear portion
7 Support, bottom traction belt
8 Product, rood product
8.1 Rear end of the product
9 Gripper
10 Fastening
10.1 Floating bearing, cylinder
11 Waste chute
12 Double arrow

What is claimed is:

1. A slicing device comprising:

a cutting blade separating slices from a front end of a food product, a support on which the food product rests, an endless belt conveying the food product in a direction of the cutting blade and/or pressing the food product against the support, and a gripper, wherein the gripper is arranged on the endless belt, the gripper is conveyed with the endless belt in a direction of a rear end of the food product to grip the rear end of the food product, wherein the slicing device includes a cylinder that extends from the endless belt, the cylinder extends from the endless belt in a direction that is generally perpendicular to a conveying direction of the endless belt, the cylinder is connected to the gripper, wherein after the gripper grips the rear end of the food product and after the endless belt contacts the food product, the gripper is displaced along a length of the cylinder such that spacing between the gripper and the endless belt is reduced while spacing between the gripper and the support remains constant, and wherein the endless belt comprises a first portion and a second portion, the first portion is arranged closer to the cutting blade than the second portion, the first portion is arranged generally parallel with the support, the second portion is arranged at an angle relative to the first portion.

2. The slicing device as claimed in claim 1, wherein the endless belt is a traction belt, and after the slices are cut from the food product, the endless belt pulls back the gripper in a direction away from the cutting blade.

3. The slicing device as claimed in claim 1, wherein at least the first portion of the endless belt is displaceable in a direction of the support so that a pressing force of the endless belt against the food product is increased and/or a position of the endless belt is adaptable to a height of the food product.

4. The slicing device as claimed in claim 1, wherein a bearing is arranged between the gripper and the endless belt so that the gripper is moveable in a direction of the support and in a direction away from the support.

5. The slicing device as claimed in claim 4, wherein the gripper is moveable perpendicular to the conveying direction of the endless belt.

6. The slicing device as claimed in claim 1, wherein the endless belt comprises a low-friction surface.

7. The slicing device as claimed in claim 1, wherein the gripper grips the rear end of the food product after the cutting blade has begun separating the slices from the front end of the food product.

8. The slicing device as claimed in claim 7, wherein the endless belt presses the food product against the support after the gripper grips the rear end of the food product.

9. The slicing device as claimed in claim 1, wherein the food product is located between the endless belt and the support.

10. The slicing device as claimed in claim 1, wherein the slicing device comprises a stop located between the cutting blade and the support, the stop is moveable relative to the support, wherein the food product is conveyed in the direction of the cutting blade until the front end of the food product abuts against the stop, the gripper is then conveyed in the direction of the rear end of the food product until the gripper grips the rear end of the food product, and wherein the stop is moved from between the cutting blade before the cutting blade begins separating the food slices from the front end of the food product.

11. A method for slicing a food product with the slicing device as claimed in claim 1, the method comprising:

conveying the food product resting on the support in the direction of the cutting blade, the food product being conveyed with the endless belt, conveying the gripper with the endless belt in the direction of the rear end of the food product until the gripper grips the rear end of the food product, modifying the position of the gripper relative to the endless belt with a movement component in a direction of the support, and moving at least the first portion of the endless belt in the direction of the support until the endless belt abuts the food product once the gripper has gripped the rear end of the food product.

12. The method as claimed in claim 11, wherein the endless belt is guided back into a raised position, which is in a direction away from the support again after a slicing step.

13. The method as claimed in claim 12, wherein the slicing device comprises a stop located between the cutting blade and the support, and during the conveying step the food product is conveyed in the direction of the cutting blade until the front end of the food product abuts against the stop, the gripper is then conveyed in the direction of the rear end of the food product until the gripper grips the rear end of the food product.

14. The method as claimed in claim 12, wherein the gripper is connected to the endless belt with a floating bearing so that during the step of moving at least the first portion of the endless belt in the direction of the support, the spacing between the gripper and the endless belt is reduced while the spacing between the gripper and the support remains constant.

15. The method as claimed in claim 13, wherein before the slicing step, the method includes a step of removing the stop, and after the slicing step the method includes a step of enlarging spacing between at least the first portion of the endless belt and the support so that the endless belt no longer abuts the food product.

16. The method as claimed in claim 12, wherein the method includes a step of pulling back the gripper with the endless belt in a direction away from the cutting blade.

* * * * *